US006752382B2

(12) United States Patent
Barto

(10) Patent No.: US 6,752,382 B2
(45) Date of Patent: Jun. 22, 2004

(54) CONCRETE FORM PULLER

(76) Inventor: David A. Barto, 4418 Porter Center Rd., Ransomville, NY (US) 14131

( * ) Notice: Subject to any disclaimer, the term of this patent is extended or adjusted under 35 U.S.C. 154(b) by 0 days.

(21) Appl. No.: 10/292,925

(22) Filed: Nov. 13, 2002

(65) Prior Publication Data

US 2004/0089856 A1 May 13, 2004

(51) Int. Cl.[7] ..... E21B 19/00
(52) U.S. Cl. ..... 254/131
(58) Field of Search ..... 254/29 R, 30–31, 254/120, DIG. 1, 132

(56) References Cited

U.S. PATENT DOCUMENTS 1,911,287 A * 5/1933 Pladson ..... 254/130
6,302,376 B1 * 10/2001 Williams ..... 254/30

* cited by examiner

*Primary Examiner*—Robert C. Watson
(74) *Attorney, Agent, or Firm*—Wallace F. Neyerlin

(57) ABSTRACT

A concrete form puller assembly comprising an elongated bar about 20 to 36 inches long, preferably about 27 inches long, said bar having substantially horizontal lengths at each of its ends and an angular mid-portion sloping about thirty degrees from horizontal between each of its ends, and a base assembly supporting the bar at its lower end, said base assembly comprising a base plate and two parallel side panels with a space in between for supporting and holding the lower end of the bar, said side panels having diametrically opposite holes therein near the tops of same, and a bolt inserted through the side panels and through a hole in the lower end of the bar for holding the bar in a fixed position between the side panels of said base assembly. Said assembly is capable of separating concrete forming systems from the hardened and set concrete with a minimum of damage to the concrete or chipping of the concrete; and of accomplishing the foregoing in a faster and easier manner than can be accomplished without using the concrete form puller of this invention; said assembly can separate forming systems from set concrete with reduced physical force, and with reduced injuries such as wrenching one's back in straining to remove the form from the set concrete.

14 Claims, 5 Drawing Sheets

CONCRETE FORM PULLER

BACKGROUND OF THE INVENTION

In pouring cement, Forms are used to contain the fluid cement and to shape the cement into the configuration and dimensions desired for the particular purpose. Unlike job-built formwork which must be tailored for each specific pour, Steel-Ply Forming Systems have been devised (such as by Symons, a Dayton, Ohio Company) which come in a variety of standard sizes which can be combined to form virtually any dimension. Steel-Ply panels and fillers are made of special High Density Overlay (HDO) plywood or birch plywood mounted on rugged steel frames. They can be used up to 200 times before being replyed.

Symons' Steel-Ply panels and fillers are constructed from a rugged steel frame. The side rail of the form is rolled exclusively for Symons and has a minimum yield stress of 55,000 psi. Crossmembers have a minimum yield stress of 60,000 psi and are located at one foot centers on all panels and fillers.

Symons special ½". High Density Overlay (HDO) or birch plywood provides a smooth finish. Each piece is edge sealed with polyurethane to repel moisture and prevent delamination. With proper care, contractors can expect up to 200 reuses before plywood replacement.

Steel-Ply requires little training because it has no top or bottom, left or right, and can be used vertically or horizontally. Dado slots at crossmembers simplify tie placement. Slots for hardware attachment are located between cross-members.

All Steel-Ply components combine to provide a 1000 psf rated system with a predictable safety factor over the service life of the form.

Sizes—Symons' complete Steel-Ply system consists of 80 standard panel and filler sizes. Panel and filler heights range from 3' to 8', in 1' increments. Panel widths are 24" and filler widths range from 4" to 22", in 2" increments. A 5" wide filler and steel 1", 1½", and 2" fillers are also available. Wedge Bolts connect panels, fillers and ties in one simple operation. Steel Fillers—Symons' Steel Fillers are cold-formed U-shaped steel. The 1" and 1½" steel fillers are punched with connecting slots at 6" O.C. A Long Bolt passes through the steel filler to grip adjoining panel side rails.

The 2" Steel Filler has connecting slots at 2" O.C. It is used to "step" forms in 2" increments. This steel filler reduces the need to build up under forms when step footings or changing wall elevations occur.

Connecting Hardware

Wedge Bolts

Two identical Wedge Bolts function as a lock-bolt set, one as a connecting bolt, the other as a clamping wedge. At typical siderail-to-siderail connections, the loop end of the tie is positioned in dado slots and is secured by the same Wedge Bolts.

For typical walls, form connecting Wedge Bolts are only required at standard tie connection positions. Additional Wedge Bolts are utilized at other positions for attachment of walers, scaffold brackets or other accessory components.

Long Bolts

The Long Bolt is designed to be used with the 1", 1½" and 2" Steel Filler. The long connecting bolt is punched with tow ¼" holes to accommodate a 16D nail to be used to shorten the bolt for Steel Fillers. A vertical Wedge Bolt secures the two panels and filler through the adjoining side rails.

Base Tie Bolts

The Base Tie Bolt secures a tie to an endrail or a siderail resting on a footing. It also can be used in situations where panels butt against an existing vertical surface.

SUMMARY OF THE INVENTION

It is an object of this invention to separate forming systems from the hardened and set concrete with a minimum of damage to the concrete or chipping of the concrete.

It is another object of this invention to accomplish the foregoing in a faster and easier manner than can be accomplished without using the concrete form puller of this invention.

It is another object of this invention to separate forming systems from set concrete with reduced physical force, and to reduce injuries such as wrenching one's back in straining to remove the form from the set concrete.

It is another object of this invention to accomplish the foregoing by the use of the puller device of this invention which can be easily and inexpensively manufactured.

Broader aspects of the invention and devices within the scope of same will become clear from a further reading of the specification and claims and a consideration of the drawings

BRIEF DESCRIPTION OF THE DRAWINGS

FIG. 3*b* being a top view;

FIG. 7 shows the same as FIG. 6, with the steel fillers manually removed leaving only panels attached to the wall, with re-inforcing bar in-between;

DETAILED DESCRIPTION OF THE DRAWINGS

Figure 1A:
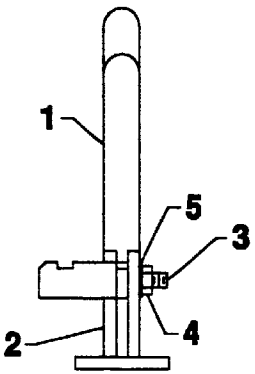
FIGS. 1, 1*a* and 1*b* are views of the concrete form puller or concrete panel remover assembly, FIG. 1 being a side view, FIG. 1*a* being an end view and FIG. 1*b* being a top view.
Figure 1B:
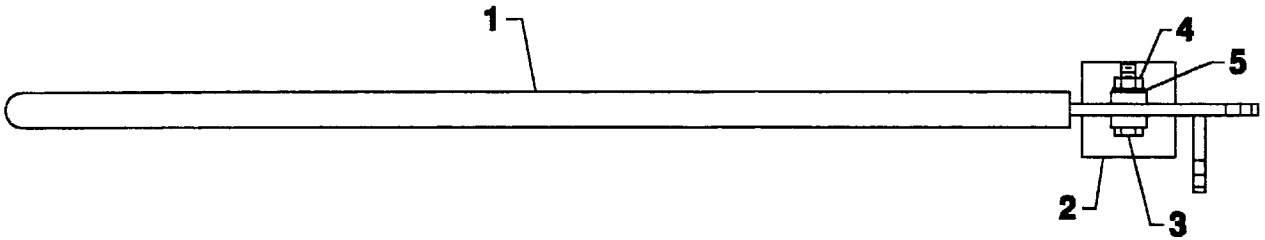
Figure 1:
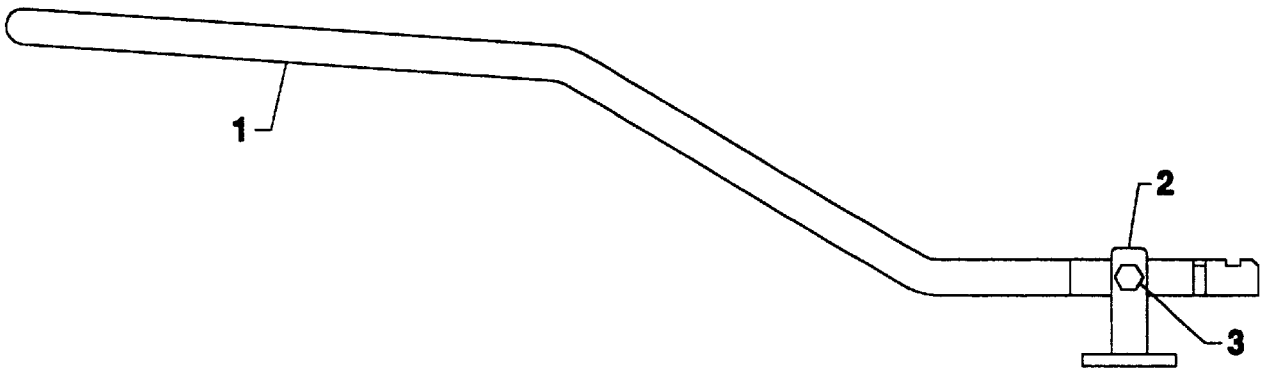

In FIGS. 1, 1*a* and 1*b* numeral 1 denotes the bar of the panel remover assembly, numeral 2 denotes the base assembly, numeral 3 denotes a bolt, numeral 4 denotes a nut and numeral 5 denotes a washer. An operating bar length may typically vary between about 20 inches and 36 inches. A preferred length of the bar 1 is about 27 inches, the horizontal part at the right end of the bar being about 7 inches long, the angular portion of the bar leading from the horizontal portion being about 8 inches long at about a 30 degree angle from the horizontal portion, and the remaining portion of the bar being about 12 inches long at an angle of about 4 degrees from the middle portion of the bar. The bar's height from horizontal is about 9 inches. Bolt 3 is typically about 5/16 inches in diameter with a hexagonal head and about inches long. Nut 4 is also about 5/16 inches in diameter; and washer 5 is also about 5/16 inches in diameter with a thickness of about inch. The bar preferably is made from about ¼ inch thick hardened steel and about ¾ inches wide.

Figure 2B:
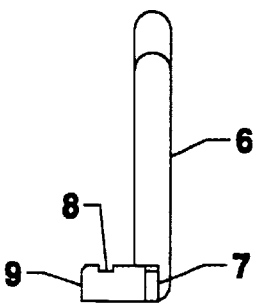
FIGS. 2, 2*a* and 2*b* are side, top and end views, respectively, of the bar/handle or concrete form puller assembly.
Figure 2A:
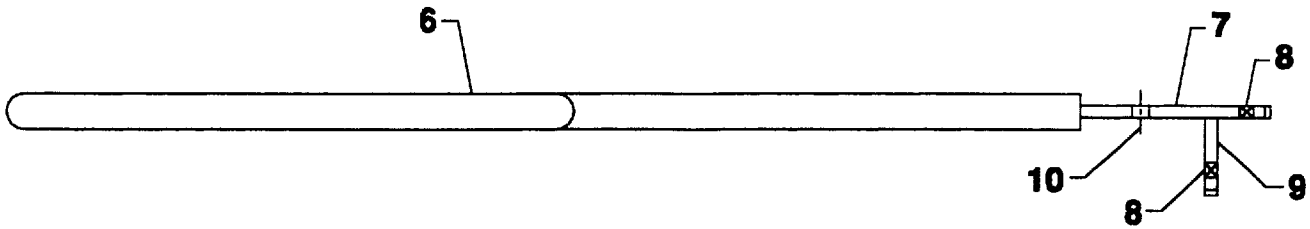
Figure 2:
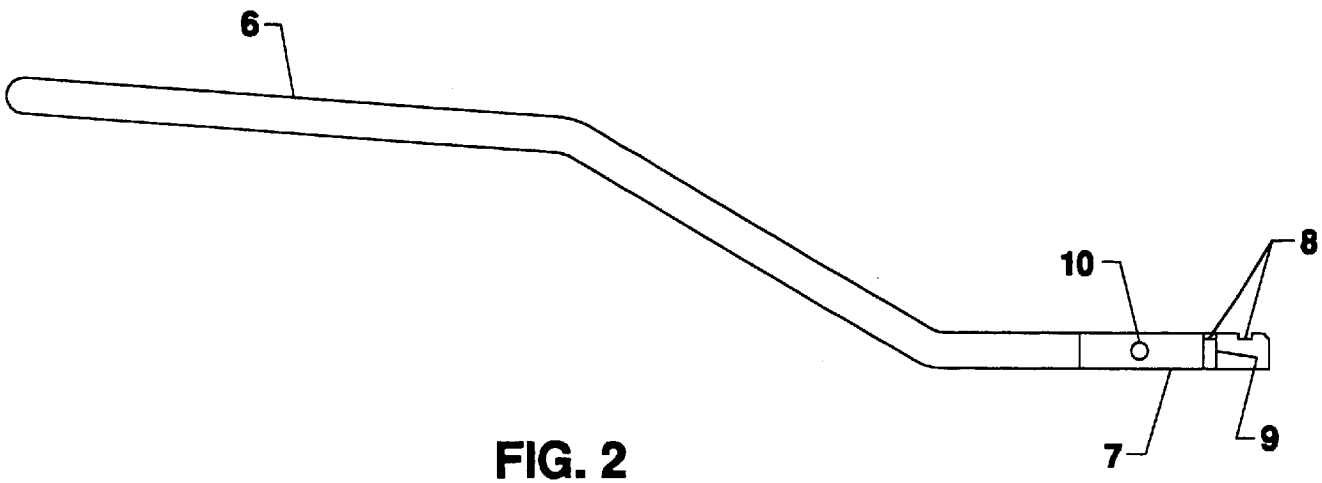

In FIGS. 2, 2*a* and 2*b*, numeral 6 depicts the ¾ inch wide bar, numeral 7 depicts the ¼ inch thick flat stock panel puller for horizontal application with notch 8, notch 8 being about 5/16 inch long with a ⅛ inch notch. Numeral 9 depicts ¼ inch thick flat stock panel puller for vertical application with notch 8 and numeral 10 depicts a ⅜ inch diameter hole for base assembly attachment.

Figure 3B:
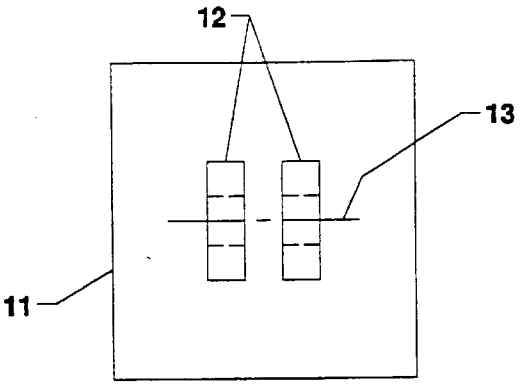
FIGS. 3 and 3*a* and 3*b* are views of the base assembly of the puller, FIG. 3 being a side view, FIG. 3*a* being a cross-sectional view.
Figure 3A:
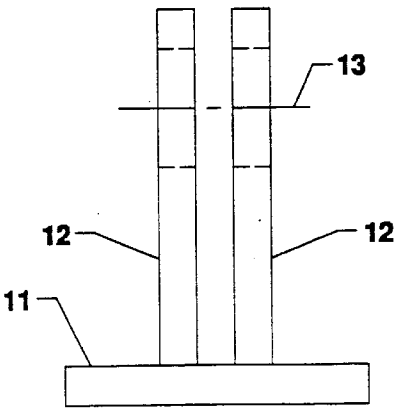
Figure 3:
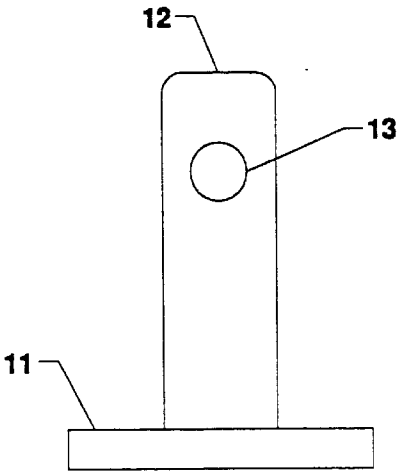

In FIGS. 3, 3*a* and 3*b*, which depict the base assembly of the puller, numeral 11 depicts a ¼ inch thick base plate which is about 2 inches wide, numeral 12 depicts ¼ inch thick side panels and numeral 13 depicts a ⅜ inch diameter hole for bar handle assembly attachment. Side panels 12 are typically about 2¼ inches high from the upper surface of the base plate 11 and the space between the side panels is about ¼ inch.

Figure 4:
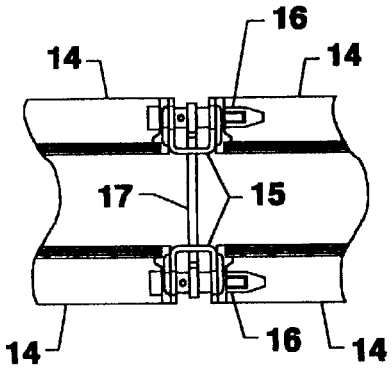
FIG. 4 shows a side view of the concrete form panel and steel filler setup.
Figure 5:
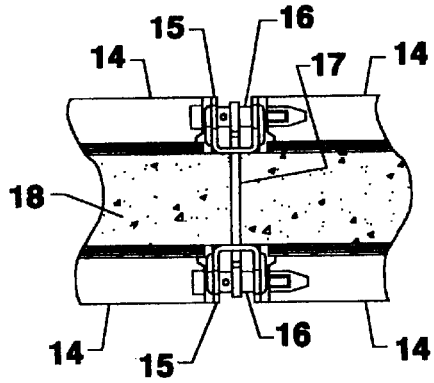
FIG. 5 shows the same as FIG. 4 but with concrete mix poured into the form panel.

FIG. 4 illustrates a side view of the panel and steel filler setup for the pouring of the cement; FIG. 5 shows the same setup as FIG. 4, with the cement poured.

Figure 6:
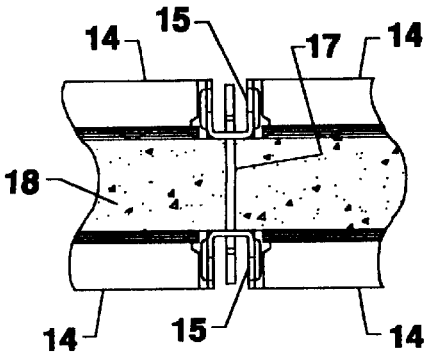
FIG. 6 shows the same as FIG. 5 with the wedge bolts 16 removed after the poured concrete wall has set.
Figure 7:
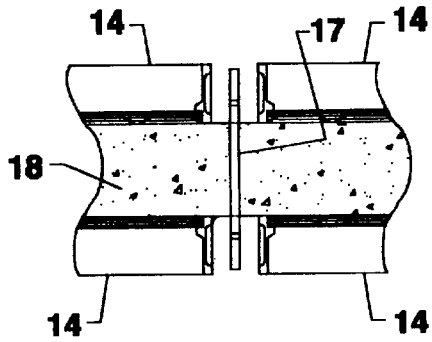

FIG. 6 shows the same as FIG. 5 with the wedge pins 16 removed after the concrete wall has set; and FIG. 7 shows the same as FIG. 6 with the steel fillers manually removed, leaving only wall panels attached to the wall with the re-inforcing wall ties 17 in-between.

In these four Figures, numeral 14 designates Symons steel-ply wall panels, numeral 15 designates Symons steel fillers, numeral 16 designates wedge pins or bolts, numeral 17 designates wall ties and numeral 18 designates tie set concrete.

Figure 8:
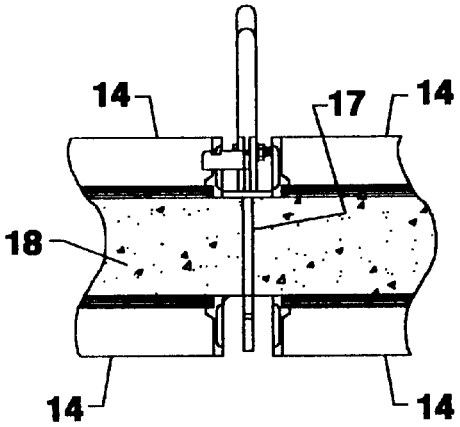
FIGS. 8 and 9 illustrate the concrete panel puller at vertical application.
Figure 9:
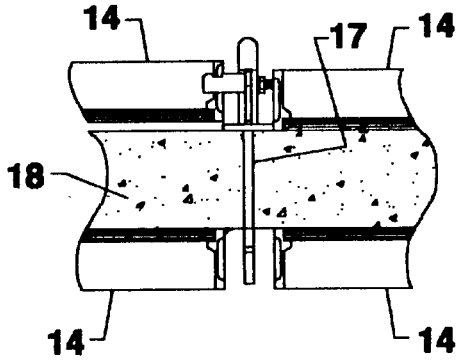
Figure 10:
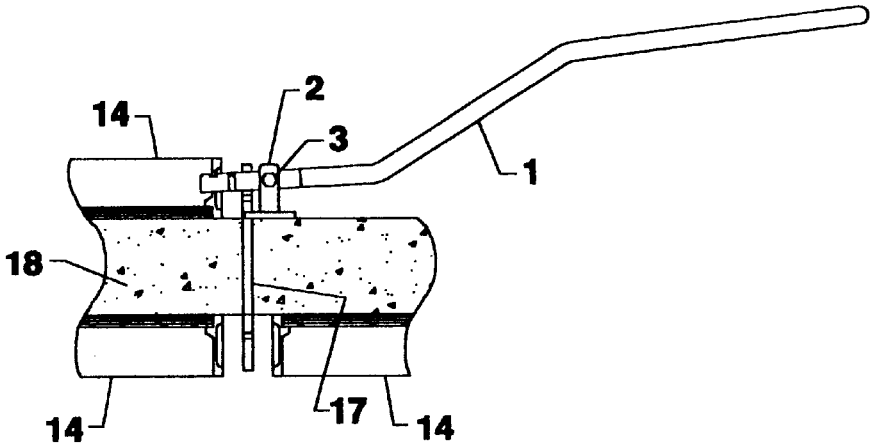
FIGS. 10 and 11 show illustrations of the use of the panel puller or concrete form puller at its various degrees of horizontal application in pulling the forms out of the set concrete.
Figure 11:
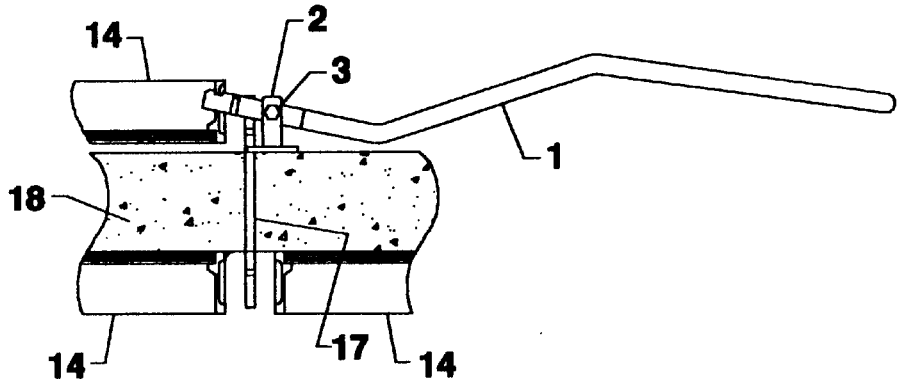

FIGS. 8 and 9 are illustrations of the panel puller at various degrees of vertical application in pulling the steel fillers 15 out of the set concrete, it being noted that the end of the puller fits into the portion of the panel 14 where the wedge pins or bolts were located. FIGS. 10 and 11 show illustrations of the use of the panel puller or concrete form puller at its various degrees of horizontal application in pulling the forms out of the set concrete. The force applied in removing the steel fillers 15 from the set concrete being accomplished by the use of the tool pushing down on the end of the tool 1 to pull the steel filler 15 out of the set concrete 18.

Having described this invention, it should be apparent that numerous structural modifications and adaptations may be resorted to without departing from the scope and fair meaning of the invention.

I claim:

1. A concrete form remover assembly comprising an elongated bar about 20 to 36 inches long, said bar having substantially horizontal lengths at each of its ends and an angular mid-portion sloping about thirty degrees from horizontal between each of its ends, and a base assembly supporting the bar at its lower end, said base assembly comprising a base plate and two parallel side panels with a space in between for supporting and holding the lower end of the bar, said side panels having diametrically opposite holes therein near the tops of same, and a bolt inserted through a hole in the lower end of the bar for holding the bar in a fixed position between the side panels of said base assembly, said lower end of the bar having notch depressions in same for levered engagement with the steel frame of the concrete form in order to forcibly remove the form from the set concrete.

2. A concrete form remover assembly according to claim 1 wherein the elongated bar is about 27 inches long.

3. A concrete form remover assembly according to claim 1 wherein the elongated bar is made from about ¼ inch thick hardened steel and is about ¾ inches wide.

4. A concrete form remover assembly according to claim 1 wherein the base plate is about ¼ inch thick and about 2 inches wide.

5. A concrete form remover assembly according to claim 1 wherein the side panels are about ¼ inch thick and about 2 inches high from the upper surface of the base plate.

6. A concrete form remover assembly according to claim 1 wherein the space between the side panels is about ¼ inch.

7. A concrete form remover assembly according to claim 1 wherein the elongated bar is about 27 inches long and the horizontal part at the right end of the bar is about 7 inches long, the angular portion of the bar leading from the horizontal portion is about 8 inches long at about a 30 degree angle from the horizontal portion and the remaining portion of the bar is about 12 inches long at an angle of about 4 degrees from the middle portion of the bar.

8. A concrete form remover assembly comprising an elongated bar about 20 to 36 inches long, said bar having substantially horizontal lengths at each of its ends and an angular mid-portion sloping about thirty degrees from horizontal between each of its ends, and a base assembly supporting the bar at its lower end, said base assembly comprising a base plate and two parallel side panels with a space in between for supporting and holding the lower end of the bar, said side panels having diametrically opposite holes therein near the tops of same, and a bolt inserted through a hole in the lower end of the bar for holding the bar in a fixed position between the side panels of said base assembly, said lower end of the bar having notch depressions in same for levered engagement with the steel frame of the concrete form in order to forcibly remove the form from the set concrete, and wherein the levered engagement of the bar with the steel frame of the concrete form is just beyond the point where the lower end of the bar is held in a fixed position between the side panels of said base assembly.

9. A concrete form remover assembly according to claim 8 wherein the elongated bar is about 27 inches long.

10. A concrete form remover assembly according to claim 8 wherein the elongated bar is made from about ¼ inch thick hardened steel and is about ¾ inches wide.

11. A concrete form remover assembly according to claim 8 wherein the base plate is about ¼ inch thick and about 2 inches wide.

12. A concrete form remover assembly according to claim 8 wherein the side panels are about ¼ inch thick and about 2 inches high from the upper surface of the base plate.

13. A concrete form remover assembly according to claim 8 wherein the space between the side panels is about ¼ inch.

14. A concrete form remover assembly according to claim 8 wherein the elongated bar is about 27 inches long and the horizontal part at the right end of the bar is about 7 inches long, the angular portion of the bar leading from the horizontal portion is about 8 inches long at about a 30 degree angle from the horizontal portion and the remaining portion of the bar is about 12 inches long at an angle of about 4 degrees from the middle portion of the bar.

* * * * *